US005931747A

United States Patent [19]

Mast

[11] Patent Number: 5,931,747

[45] **Date of Patent: *Aug. 3, 1999**

[54] GOLF BALL

[76] Inventor: Timothy Mast, 1 Kalia Cir., Andover, Mass. 01810

[ * ] Notice: This patent is subject to a terminal disclaimer.

[21] Appl. No.: 08/935,607

[22] Filed: Sep. 23, 1997

Related U.S. Application Data

[63] Continuation-in-part of application No. 08/698,548, Aug. 15, 1996.

[51] Int. Cl.[6] ..... A63B 37/06; A63B 37/12

[52] U.S. Cl. ..... 473/352; 473/365; 473/377; 473/378; 273/DIG. 20; 273/DIG. 15

[58] Field of Search ..... 473/352, 378, 473/377, 365; 273/DIG. 15, DIG. 20

[56] References Cited

U.S. PATENT DOCUMENTS 2,364,955 12/1944 Diddel ..... 473/352 X 4,085,937 4/1978 Schenk ..... 473/352

5,674,137 10/1997 Maruko et al. ..... 473/378 X

*Primary Examiner*—George J. Marlo

*Attorney, Agent, or Firm*—Henslin & Rothenberg, P.C.

[57] ABSTRACT

A golf ball constructed of a molded outer cover defining an outer diameter of the golf ball of about 1.8 to 2.5 inches, and preferably between 1.8 and 2.2 inches. One or more inner materials within the golf ball is of a sufficient density to allow the golf ball to float in water. The golf ball may comprise an inner core of a light weight material of sufficient density to allow the golf ball to float. The golf ball will have the characteristics and feel of a conventional golf ball while being able to float. The increased size of the golf ball will give the beginning golfer an easier target to strike with the club face thereby improving his or her confidence in ball striking ability. The increased size will also increase the wind resistance and thereby overemphasizing balls hit with improper spin, resulting in quicker learning time. Better golfers can use this feature to practice and perfect cut and draw shots. The golf ball may used during actual rounds of golf or in training on the driving range.

23 Claims, 1 Drawing Sheet

GOLF BALL

CROSS REFERENCE TO RELATED APPLICATION

This application is a continuation-in-part of U.S. patent application Ser. No. 08/698,548 filed on Aug. 15, 1996.

BACKGROUND OF THE INVENTION

This application relates to the field of golf balls.

Since a conventional golf ball is typically 1.68 inches in diameter it is a relatively small object. For this reason, beginning golfers often have difficulty striking a conventional golf ball with a golf club. This problem is often compounded by a golf ball's hardness because beginning golfers often are apprehensive about firmly striking such a hard object. To assist in making contact with a golf ball, beginning golfers may be tempted to place the golf ball on a tee, even when in the fairway during a round of golf. The use of a tee gives the beginner the feeling that the golf ball is larger, therefore, making it easier to strike with a club.

The fear of mis-hitting a conventional golf ball typically increases when the beginning golfer, while playing a round of golf, is confronted with a situation where he or she must hit the ball over a water hazard. Many golfers, particularly, beginning golfers are typically nervous about hitting the golf ball into the water and losing the same therein. To avoid this problem, the beginning golfer may tee the ball up in order to make better contact therewith and hopefully hit the ball over the water.

Alternatively, the golfer may first play the ball short of the water and then play the ball over the water with a second shot costing him or her an extra stroke. These and other problems may be overcome by the beginning golfer by increasing his or her confidence and ball striking ability.

There may exist certain training aids which assist the beginning golfer in improving his or her ball striking ability. However, golf training aids are typically not legally allowed to be used during a round of golf. Therefore, the training aids are usually used at home or on the driving range. Unfortunately, increased confidence and improved golfing is usually accomplished by playing actual rounds of golf on the golf course.

There exists a need, therefore, for a golf ball which will allow beginning golfers to improve their ball striking ability and which can be used during actual rounds of golf. It is also desirable, that such a golf ball meet United States Golf Association ball specifications. Specifically, a golf ball should be no smaller than 1.68 inches and no more than 1.62 ounces.

In addition, such a golf ball should have the "feel" of a conventional golf ball while also possessing the same or similar flight characteristics and controllability. The beginning golfer will, therefore, know if he or she has a tendency to hook, slice, fade or draw a golf ball.

It is also desirable that the golf ball not sink when hit into a water hazard. This may help the beginning golfer feel more confident about hitting the ball over the water and not worry about losing the ball in the water.

Improving the beginner golfer's ball striking ability during play should help build his or her confidence in hitting the ball thereby improving the golfer's game. If the aforementioned features are present within a golf ball, it may be used during rounds of golf by the beginning golfer without violating United States Golf Association rules. The ball should travel similar to a conventional golf ball and should be able to be putted into the cup on the green.

SUMMARY OF THE INVENTION

The aforementioned goals may be achieved using the golf ball constructed in accordance with the principles of the present invention. Such a golf ball may be comprised of a molded cover defining the size of the golf ball to be less than 2.5 inches in diameter, and preferably between about 1.68 and 2.2 inches. Within the cover, the golf ball may have one or more inner materials. The inner materials should be of a collective density which allows the golf ball to be below 1.62 ounces in weight while also allowing the golf ball to float in water.

In one aspect of the invention, the golf ball may be a three piece ball including a layer of elastic material, a molded cover over the layer of elastic material, and a center core enclosed by the layer of elastic material. The molded cover defines the overall size of the golf ball to be preferably between about 1.68 to 2.2 inches in diameter. The center core may be comprised of a material having a density sufficient to allow the golf ball to float in water while the golf ball is no more than about 1.62 ounces in weight.

In another aspect of the invention, the golf ball may be a two piece golf ball, again preferably of a diameter of between 1.68 and 2.2 inches. An outer cover material, such as the types previously mentioned may be used. The inner material may include a typical inner core material conventionally used in two piece golf balls. However, the overall density of the golf ball should be such so the golf ball floats in water.

The layer of elastic material may comprise stretched elastic windings. The center core of the golf ball may be comprised of a natural or synthetic cork material. The cover of the golf ball may be comprised of a thermoplastic resin including balata, Surlyn®, zylin or an elastonomer. The center core may be of a diameter of about 1.7 inches or less, the elastic material may be of a thickness of between about 0.23 to 0.25 inches, and the cover material of a thickness of between about 0.06 inches to 0.08 inches.

The golf ball, being preferably between 1.68 and 2.2 inches in diameter may be up to 25% larger than a conventional golf ball and, therefore, is easier to hit particularly by beginning golfers. The golf ball may be used during rounds of play by beginning golfers to help increase their confidence and ball striking ability. Moreover, when using a thermoplastic resin as the cover material and elastic windings as an intermediate layer over a center core within the golf ball, the golf ball will have the weight and the feel of a conventional golf ball with similar flight characteristics. These attributes are highly desirable during actual rounds of golf.

DETAILED DESCRIPTION

Figure 1:
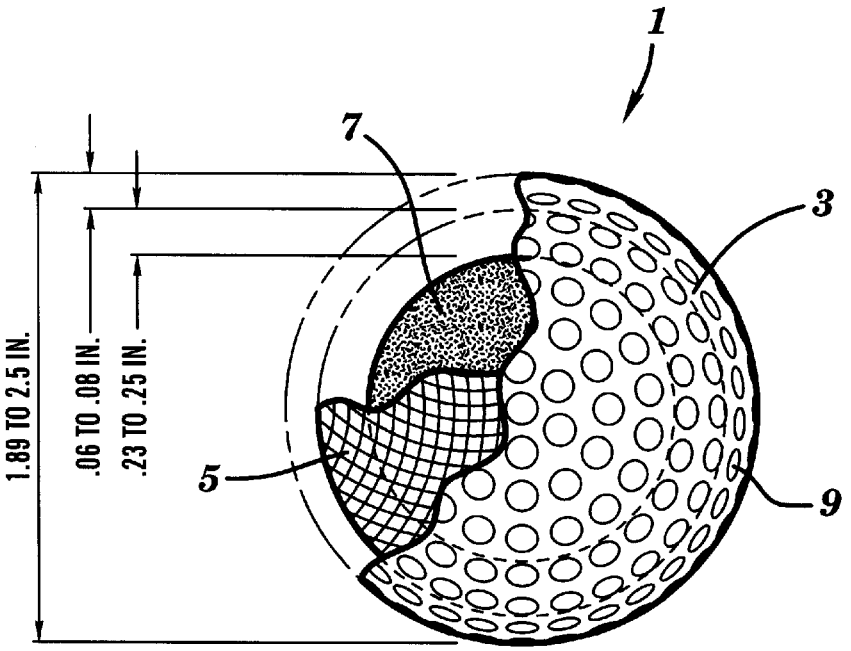
FIG. 1 is a sectional view of a three piece golf ball constructed in accordance with the principles of the present invention having a portion of the cover and inner materials removed therefrom.

Referring now to FIG. 1, a preferred embodiment of the golf ball 1 constructed in accordance with the principles of the present invention is shown. The golf ball 1 includes an outer cover 3 with one or more inner materials 5, 7 being surrounded or encapsulated by the cover. The outside diameter of the golf ball 1 should be less than 2.5 inches, but preferably generally between 1.68 and 2.2 inches. Since the standard golf ball is 1.68 inches in diameter, the golf ball of the present invention may be approximately 25% bigger than the standard golf ball. This larger size ball may allow the beginning player to feel more confident about striking the ball during play on a regulation golf course. The weight of the golf ball should be no more than 1.62 ounces in order to conform with United States Golf Association rules for ball specifications. Using these parameters, the inner materials 5, 7 of the golf ball 1 should have a collective density which gives the golf ball a weight which is lighter than water displaced thereby so that the golf ball floats.

The inner materials 5, 7 may comprise a central core 7, preferably spherical in shape, which is wound thereover with a layer of elastic material 5, preferably a stretchable rubber thread. The elastic thread may be stretched as it is wrapped tightly around the center core 7 to achieve characteristics similar to a typical 3 piece ball with a compression rating of 80–90. An example of a technique for creating a layer of elastic material within a golf ball using elastic thread is disclosed in U.S. Pat. No. 4,783,078 the specification of which is incorporated herein by reference and made a part of the disclosure herein.

The center core 7 should be made of a sufficiently light material to give the golf ball a collective density which will allow it to float. A natural or synthetic cork material which is of relatively lightweight may be used as the center core material 7. However, other materials such as polyresins also of sufficient density to allow the golf ball to float may also be used as the center core 7 material. In addition, materials other than wound rubber or string may be used as the elastic material 5.

Since the golf ball of the present invention is the same in weight as a conventional golf ball it may travel less distance upon impact with a golf club. If elastic rubber windings are used as an intermediate material, the windings could be stretched to a lesser or greater degree than in a conventional golf ball. This may tend to give the ball a slightly softer or harder feel, respectively, while having similar flight characteristics of a conventional golf ball.

The cover material 3 is preferably made of a thermoplastic resin as is well known in the art. Materials such as natural or synthetic balata; any variety Surlyn® resins, available from E.I. duPont de Nemours, Inc. of Wilmington, Delaware; zylin or an elastonomer may be used as the cover material 3. A plurality of dimples 9 are typically embedded within the cover material 3 to impart the aerodynamic characteristics to the golf ball 1. Any number of different dimple patterns such as octahedron, dodecahedron, icosahedron, tetrahedron or cube, which are well known in the art may be used and the invention is not limited to either a particular cover material 3 or a dimple pattern 9.

Having an outside diameter between 1.68 to 2.5 inches for the golf ball 1, and an overall weight of no more than 1.62 ounces (as required by United States Golf Association rules) may impart certain constraints to the amount of material used for the inner materials 5, 7 and cover 3 of the golf ball. One embodiment of the golf ball of the present invention may use a natural or synthetic cork such as a pressed cork having a typical coefficient of restitution of approximately 0.45 for the inner core, and a elastic rubber string or thread material for the elastic material layer 5, and an outer Surlyn® cover having a thickness of between 0.06 to 0.08 inches. The coefficient of restitution of the golf ball should be at least 0.77 and preferably between 0.77 and 0.80 as set forth in U.S. Pat. No. 5,470,075, the specification of which is incorporated herein by reference and made a part of this disclosure. The coefficient of restitution of the golf ball can be varied by adjusting the tension of elastomeric windings used as the elastic material layer. In one embodiment, the diameter of the center core 7 may be between about 1.6 inches to 1.7 inches for a cork center core 7 and the intermediate layer of elastic rubber windings 7 may be 0.23 inches to 0.25 inches thick. Thus, a golf ball with a cover thickness of 0.06 inch would have a diameter of 1.89 inches.

Of course, the specific thicknesses of each material, i.e., the core 7, the intermediate layer 5, and the cover 3, may be varied depending upon the specific outside diameter of the golf ball which should be between 1.6 to 2.5 inches. Moreover, the specific thicknesses of the core material 7, e.g., cork, and the elastic layer 5, e.g., rubber windings 5 may be varied depending upon the specific densities of the materials used. Moreover, the resiliency or rigidity of the inner materials, particularly an intermediate layer, may be varied to affect the distance and/or softness of the feel of the golf ball. However, the overall weight and density of the golf ball should be sufficient to allow it to float in water.

Figure 2:
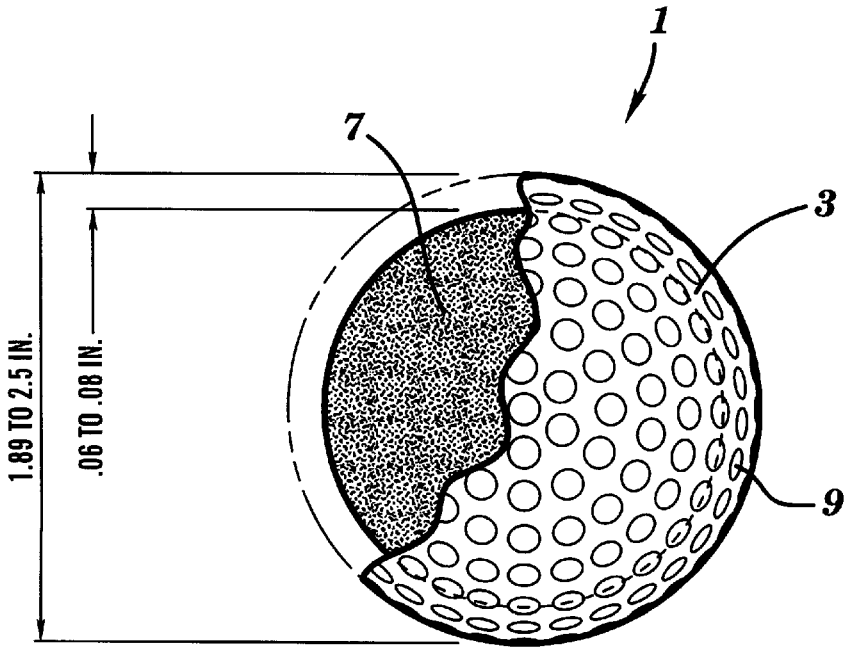
FIG. 2 is a sectional view of a two piece golf ball constructed in accordance with the principles of the present invention having a portion of the cover and inner materials removed therefrom.

The golf ball constructed in accordance with the present invention can also be constructed as a two piece golf ball. Referring to FIG. 2, the two piece golf ball includes a core material 7 surrounded by a cover material 3. The cover material may be any of the conventional cover materials as discussed supra. The core 7 may be made using any of the conventional core materials used for two piece golf balls as is well known in the art. The core may be made of a liquid or solid including high resiliency rubber compound which may include a blend of additives to further enhance performance. Also, the core material 7 may be made of a hard plastic such high energy acrylate or resin. If the core is made of a high resiliency rubber, natural or synthetic rubbers may be used. The core 7 of the two piece golf ball may be made of, for example, polybutadiene or a variation thereof. Typically, the cover of the two piece golf ball would be approximately 0.06 to 0.08 inches thick. If the cover is 0.6 inches thick so that the diameter of the inner core should be between 1.62 and 2.14 inches for a golf ball having preferably an outer diameter between 1.68 and 2.2 inches. However, with an outer diameter of up to potentially 2.5 inches, the inner material could be 2.44 inches. The collective density of the two piece golf ball should be low enough to allow the golf ball to float in water. Accordingly, the core material of the two piece golf ball may be made of a light enough density, by injection with air or another gas, so that the collective density of the golf ball is less than the density of water.

Using the aforementioned materials and characteristics will tend to give the golfer a typically normal feel to the golf ball upon impact. In addition, the larger diameter, as compared to conventional golf balls, provides the golfer with a larger object to hit. This should facilitate improved confidence and golf play particularly for beginners who may initially have trouble making appropriate contact with a conventional sized golf ball. Conveniently, the golf ball will float if hit into water. Therefore, even if the beginning golfer, while playing a round of golf, hits the golf ball into a water hazard, it can be easily retrieved using a conventional ball retriever or other object from the surface of the water.

The golf ball constructed in accordance with the principles of the present invention may be used as any conventional golf ball either during practice or while playing a round of golf on either a conventional or shortened (par 3)

golf course. The ball may be teed up using a conventional tee when hitting off a tee. However, the ball is of a sufficiently larger size than a conventional golf ball to be played directly off the fairway, rough, or other playable hazard. The golf ball may, therefore, not be hit off a tee during the play of a round on the fairway even by beginning golfers.

Although the golf ball constructed in accordance with the principles of the present invention has been described in accordance with the embodiment discussed herein, it will be apparent to one of ordinary skill in the art that various modifications to the golf ball including the use of alternative materials may be made. These modifications are intended to be within the scope of the invention as defined by the following claims.

What is claimed is:

1. A golf ball comprising:

a layer of elastic material;

a molded cover covering said layer of elastic material, said molded cover defining the overall size of the golf ball and being about 1.89 inches to 2.5 inches in diameter;

a center core enclosed by said layer of elastic material, the center core being comprised of a material having a density sufficient to allow the golf ball to float in water; and wherein the weight of the golf ball is no more than about 1.62 ounces.

2. The golf ball of claim 1 wherein said overall size of the golf ball is between 1.89 and 2.2 inches in diameter.

3. The golf ball of claim 2 wherein said layer of elastic material is of a thickness between about 0.23 inches and 0.25 inches.

4. The golf ball of claim 3 wherein said layer of elastic material comprises stretched elastic windings.

5. The golf ball of claim 4 wherein the center core is of a diameter of about 1.7 inches or less.

6. The golf ball of claim 5 wherein the center core is comprised of a cork material.

7. The golf ball of claim 1 wherein said layer of elastic material comprises stretched elastic windings.

8. The golf ball of claim 7 wherein said layer of elastic material id of a thickness between about 0.23 inches to 0.25 inches.

9. The golf ball of claim 1 wherein said cover is comprised of a thermoplastic resin.

10. The golf ball of claim 1 wherein said cover is of a thickness between about 0.06 inches to 0.08 inches.

11. The golf ball of claim 10 wherein said cover is comprised of a thermoplastic resin.

12. The golf ball of claim 11 wherein said cover is comprised of one of balata, Surlyn®, zylin or an elastonomer.

13. A golf ball comprising:

a molded outer cover defining the size of the golf ball and having an outer diameter of 1.89 inches to 2.5 inches;

one or more inner materials encapsulated by said cover, said inner materials and said outer cover defining the weight of said golf ball, said weight being no more than about 1.62 ounces; and the one or more inner materials being of a collective density sufficient to allow the golf ball to float.

14. The golf ball of claim 13 wherein said outer diameter is between 1.89 inches and 2.2 inches.

15. The golf ball of claim 14 wherein said one or more inner materials comprises an elastic material.

16. The golf ball of claim 15 wherein said outer cover comprises a thermoplastic resin.

17. The golf ball of claim 15 wherein said elastic material is of a thickness between about 0.23 inches to 0.25 inches.

18. The golf ball of claim 14 wherein said golf ball is a two piece golf ball.

19. The golf ball of claim 17 wherein said golf ball is a two piece golf ball comprising a center core comprises a plastic material.

20. The golf ball of claim 19 wherein said cover is of a thickness between about 0.06 inches to 0.08 inches.

21. The golf ball of claim 20 wherein said cover is comprised of one of balata, Surlyn®, zylin or an elastonomer.

22. The golf ball of claim 18 wherein said one or more inner materials is comprised of a rubber material.

23. The golf ball of claim 22 wherein said cover is of a thickness between about 0.06 inches to 0.08 inches.

* * * * *

UNITED STATES PATENT AND TRADEMARK OFFICE

CERTIFICATE OF CORRECTION

PATENT NO. : 5,931,747

DATED : August 03, 1999

INVENTOR(S) : Timothy Mast

It is certified that error appears in the above-identified patent and that said Letters Patent is hereby corrected as shown below:

IN THE CLAIMS:

CLAIM 8 - Col. 5, line 43, delete "id" and replace with --is--.

Signed and Sealed this

Seventh Day of December, 1999

*Attest:*

*Attesting Officer*

Q. TODD DICKINSON

*Acting Commissioner of Patents and Trademarks*